US006435525B1

(12) United States Patent
Penicaut

(10) Patent No.: US 6,435,525 B1
(45) **Date of Patent: *Aug. 20, 2002**

(54) BRAKE FOR AN IN-LINE ROLLER SKATE

(75) Inventor: Nicolas Penicaut, Tullins (FR)

(73) Assignee: Skis Rossignol S.A., Voiron (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 438 days.

(21) Appl. No.: 08/992,999

(22) Filed: Dec. 18, 1997

(30) Foreign Application Priority Data

Dec. 31, 1996 (FR) ..... 96 16387

(51) Int. Cl.[7] ..... A63C 17/14

(52) U.S. Cl. ..... 280/11.225; 280/11.208; 280/11.216

(58) Field of Search ..... 280/11.2, 11.22, 280/11.28, 11.19, 11.204, 11.207, 11.208, 11.221, 11.215, 11.216, 11.225

(56) References Cited

U.S. PATENT DOCUMENTS 584,089 A * 6/1897 Buttermilch ..... 280/11.19
5,330,208 A * 7/1994 Charron et al. ..... 280/11.22
5,468,004 A 11/1995 Olson et al.
5,482,301 A * 1/1996 Babcock ..... 280/11.2
5,486,012 A * 1/1996 Olivieri ..... 280/11.22
5,575,489 A * 11/1996 Oyen et al. ..... 280/11.22
5,741,017 A * 4/1998 Chen ..... 280/11.2
5,794,950 A * 8/1998 Svensson et al. ..... 280/11.2
5,934,692 A * 8/1999 Artus ..... 280/11.22

FOREIGN PATENT DOCUMENTS

EP 0414521 A1 8/1990
EP 0687487 A2 12/1995

* cited by examiner

*Primary Examiner*—Robert P. Szewski
*Assistant Examiner*—James S. McClellan
(74) *Attorney, Agent, or Firm*—Bugnion S.A.; John Moetteli

(57) ABSTRACT

A brake for an in-line roller skate consisting of a rubber block (4) fixed to the end of a rigid support (5) at the rear of the skate, and intended to brake the skate by rubbing on the ground. The rigid support (5) has at least one cut-out (13) into which a piece (14) of elastic or viscoelastic material is force-fitted. This construction has the effect of damping the vibrations which are due to the block bouncing along the ground.

3 Claims, 3 Drawing Sheets

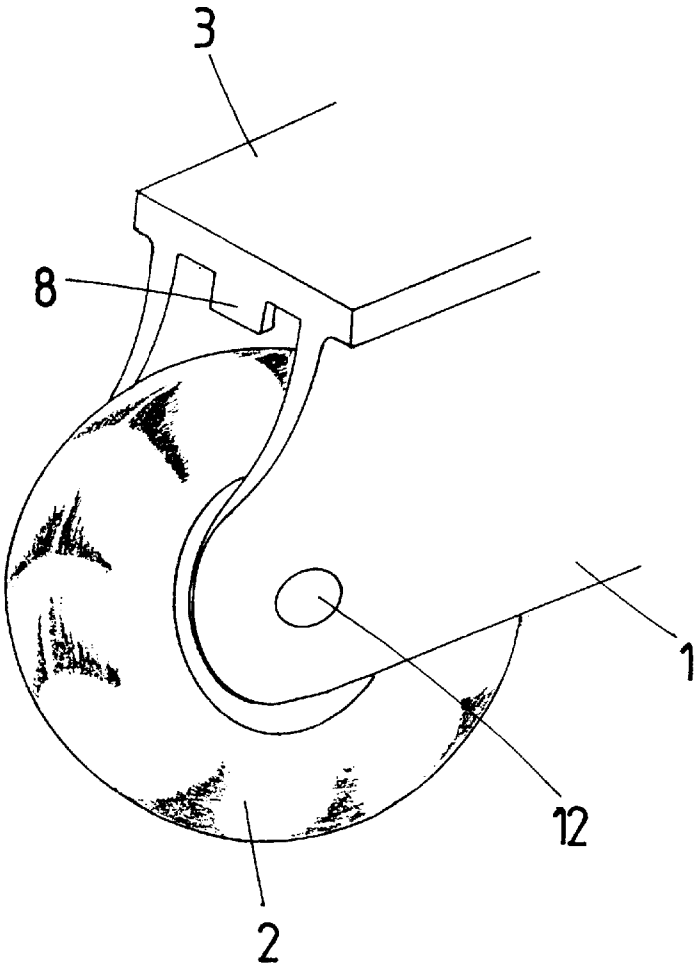
FIG. 1
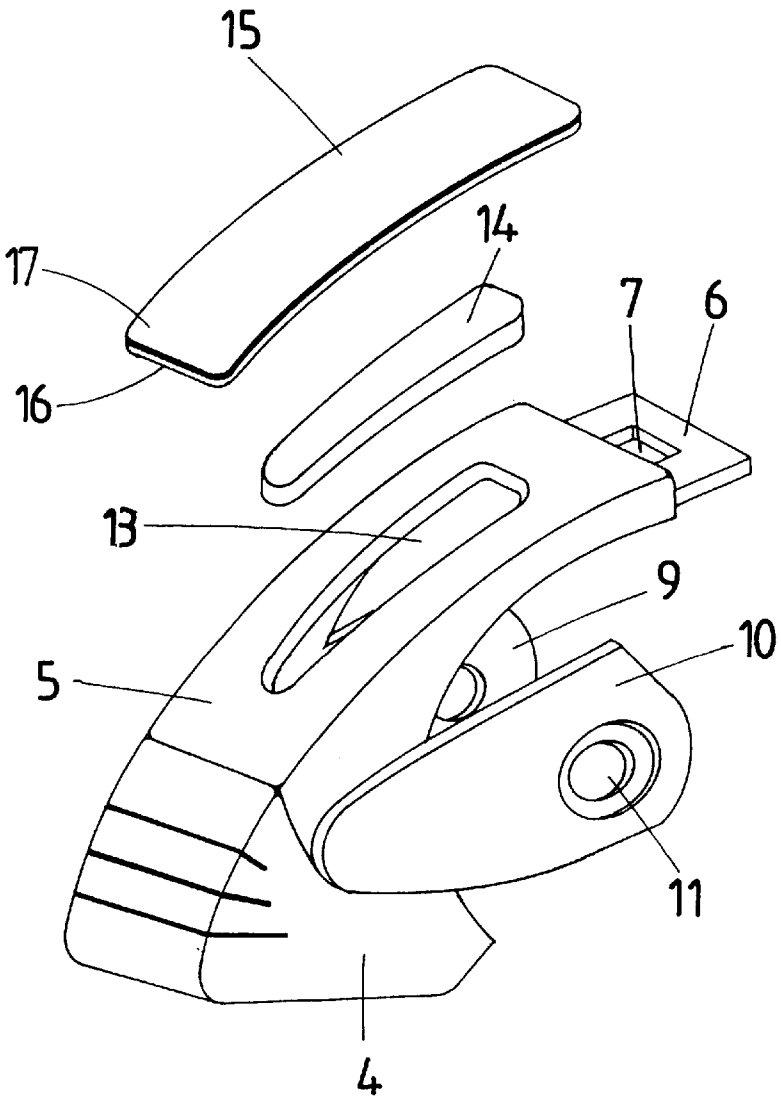

BRAKE FOR AN IN-LINE ROLLER SKATE

FIELD OF THE INVENTION

The subject of the invention is a brake for an in-line roller skate consisting of a rubber block which is fixed to the end of a rigid support at the rear of the skate and is intended to brake the skate by rubbing on the ground.

PRIOR ART

Most in-line roller skates are fitted with a brake of this kind. The brake block support may be formed as one piece with the chassis of the skate, as depicted, for example, in International Patent Application WO 96/07340 or mounted on a support articulated to the chassis and actuated by pivoting the chassis about the rear roller, as is the case, for example, with the skate described in Patent U.S. Pat. No. 5,428,301, or alternatively mounted on a support articulated to the chassis of the skate and operated by the boot, as described, for example, in Patents U.S. Pat. No. 5,486,012, EP 0694321 and EP 0705626.

When braking it has been observed that the rubber block tends to bounce along the ground causing highly undesirable vibrations which are transmitted to the leg through the skate. The phenomenon is described in U.S. Pat. No. 5,253,883 which proposes that this drawback be overcome by forming blind holes in the underside of the block that comes into contact with the ground.

SUMMARY OF THE INVENTION

The object of the invention is to eliminate the vibrations using different means which do not affect the rubber block.

The brake according to the invention is one wherein the rigid support has at least one cut-out into which a piece of elastic or viscoelastic material is force-fitted.

The results obtained with a rigid support attached to the chassis of the skate have proved very satisfactory.

BRIEF DESCRIPTION OF THE DRAWINGS

The appended drawing depicts by way of example two embodiments of the brake according to the invention.

FIG. 1 is an exploded view of the rear of a roller skate and of its brake, according to a first embodiment.

DESCRIPTION OF THE PREFERRED EMBODIMENTS

Figure 2:
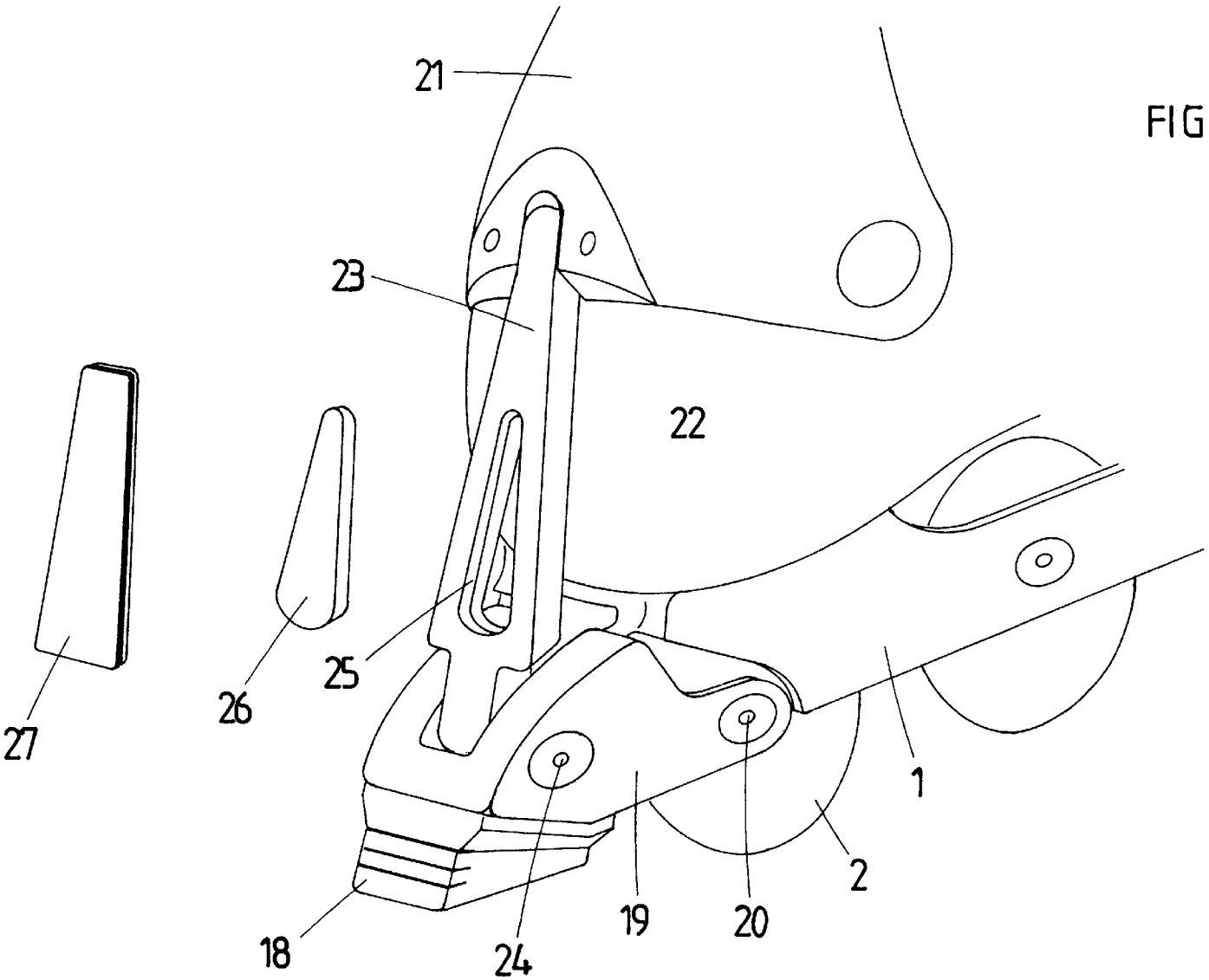
FIG. 2 is a partially exploded view of a second embodiment.

Referring now to FIG. 1, the invention is a composite rigid braking structure comprising a rubber block 4, a rigid support 5 and a chassis 1 of an in-line skate.

FIG. 1 depicts the rear of a chassis 1, for example made of aluminum, with a U-shaped profile and equipped with a number of rollers, only the rear roller 2 of which has been depicted. Also visible is a rear platform 3 to which the heel of a boot, not depicted, will be attached.

The brake consists of a rubber block 4 fixed at the end of a rigid support 5 made of metal or hard plastic, equipped at the front with a tongue 6 pierced with a hole 7 for attaching the support 5 to the chassis 1, the tongue 6 engaging under the platform 3 and the hole 7 fitting over a projection 8 of the chassis. The support 5 also has two branches 9 and 10 pierced with holes 11 via which they are articulated to the axle 12 of the rear roller 2 or directly to the chassis.

The rigid support 5 on its upper face has an oblong cut-out 13 in which a piece 14 of rubber which completely fills the cut-out 13 is force-fitted.

Instead of being made of elastic material, such as rubber, the piece 14 could be made of a viscoelastic material.

The cut-out 13 may optionally be covered by a plate 15.

This plate 15 may be made of a plastic or a metal and has a constant or variable thickness. The plate 15 may also consist of the superposition of a viscoelastic material 16 and of a sheet of aluminum 17 a plate of this kind also forming a vibration damper, the thickness of the constituent parts of which may be constant or variable.

The plate 15 may also be made up of the juxtaposition of two different viscoelastic or plastic materials.

Figure 3:
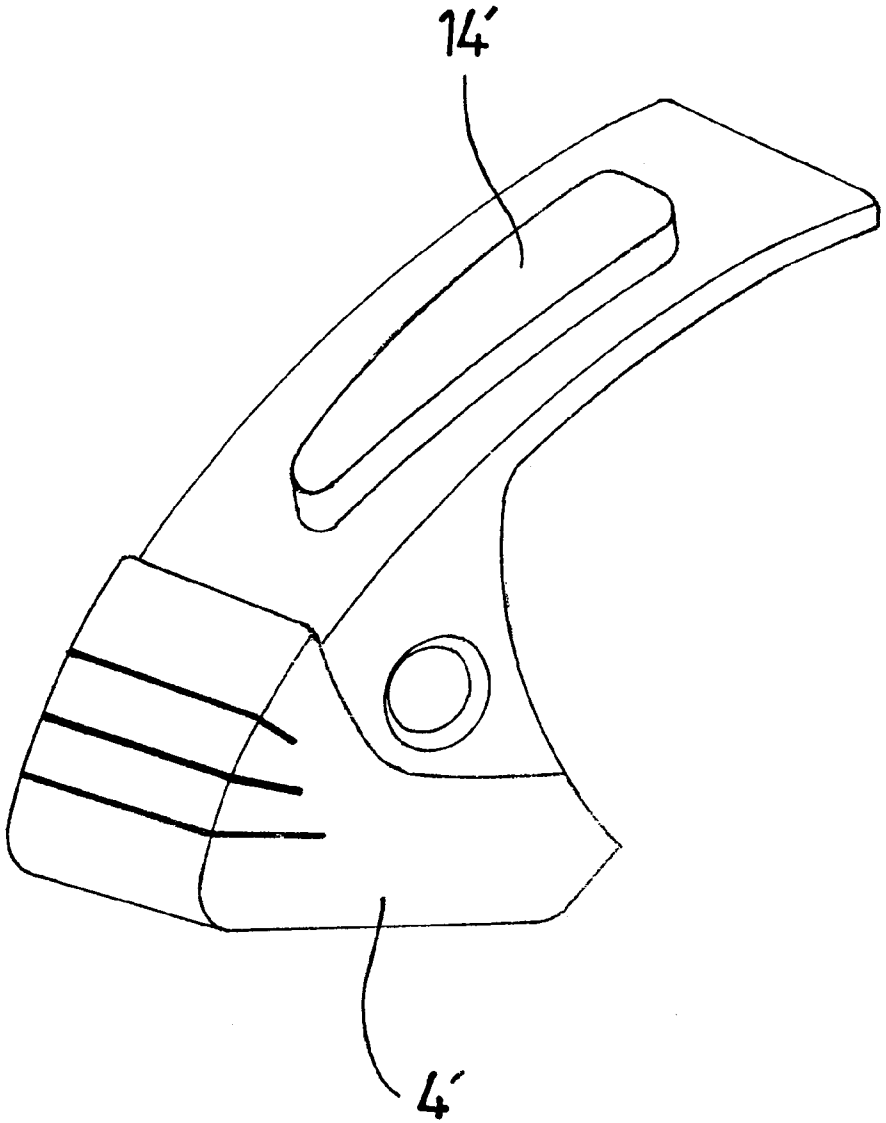
FIG. 3 is a perspective view of an alternate embodiment in which the rubber block and a resilient piece are integral.

According to an alternative form, depicted in FIG. 3, a rubber block 4' and a piece 14' are integrally molded from an elastic or viscoelastic material the piece 14 consists of part of the block 4.

In the embodiment depicted in FIG. 2, the brake once again consists of a block 18 of rubber fixed to a support 19 articulated to the chassis about an axle 20 which may be the axle of the rear roller 2. The support 19 is moreover connected to the cuff 21 of a boot 22 by a branch 23 articulated to the support 19 about an axle 24. This branch 24 has a cut-out 25 similar to the cut-out 13 of the first embodiment. A piece 26 similar to the piece 14 and which may also be covered by a plate 27 similar to the piece 15 is force-fitted into this cut-out 25.

The shape and size of the cut-outs 13 and 25 are not restricted to the embodiments depicted. This shape and these sizes may vary widely. It is possible to provide two cut-outs or more filled with an elastic or viscoelastic material.

This method of eliminating vibrations can be applied to all the types of brake mentioned in the introduction.

What is claimed is:

1. A composite rigid braking structure comprised of a chassis of an in-line roller skate, a rigid support (5; 18; 23), and a rubber block (4; 18), wherein the rubber block (4; 18) is rigidly and non-pivotally fixed to the end of the rigid support (5; 18; 23) at the rear of the skate, wherein the rigid support (5; 18 ; 23) rigidly connects the rubber block and the chassis and wherein the rigid support (5; 18, 23) has at least one cut-out (13; 25) into which a piece (14; 26) of elastic or viscoelastic material is force-fitted in a position isolating it from contact with other moving components and in a manner which permits the brake to absorb vibrations induced during braking.

2. The braking structure as claimed in claim 1, wherein the cut-out (13; 23) is of oblong shape and the piece (14; 26) of elastic or viscoelastic material fills the cut-out.

3. The braking structure as claimed in claim 1, wherein the elastic piece is integral with the brake block (4).

* * * * *